United States Patent [19]

Shibazaki et al.

[11] Patent Number: 4,459,673

[45] Date of Patent: Jul. 10, 1984

[54] COPIER EQUIPPED WITH A SYSTEM FOR TRANSMITTING INFORMATION WITH VOICE

[75] Inventors: Kenji Shibazaki, Aichi; Masazumi Itoh, Toyokawa, both of Japan

[73] Assignee: Minolta Camera Kabushiki Kaisha, Osaka, Japan

[21] Appl. No.: 531,627

[22] Filed: Sep. 13, 1983

Related U.S. Application Data

[63] Continuation of Ser. No. 261,285, May 6, 1981.

[30] Foreign Application Priority Data

May 13, 1980 [JP] Japan ..... 55-63505
Feb. 27, 1981 [JP] Japan ..... 56-28556

[51] Int. Cl.[3] ..... G10L 1/00

[52] U.S. Cl. ..... 364/513.5; 381/51; 355/14 C

[58] Field of Search ..... 364/513.5; 381/51; 355/14 C

[56] References Cited

FOREIGN PATENT DOCUMENTS 2948132 4/1980 Fed. Rep. of Germany .... 355/14 C

*Primary Examiner*—E. S. Matt Kemeny
*Attorney, Agent, or Firm*—Wenderoth, Lind & Ponack

[57] ABSTRACT

A copier including a detector for detecting malfunctions in the copier or nonoperative conditions of the copier; and a system for storing voice signals corresponding to the detected malfunctions and nonoperative conditions and a voice producer for producing a voice corresponding to each of the stored voice signals. When an operator attempts to operate the copier, a voice is produced to inform the operator of the malfunction or nonoperative condition of the copier. Voice is produced only when manual-starting or door-opening is sensed.

6 Claims, 7 Drawing Figures

START

A
1
Paper empty?
ASSEMBLY
No
Yes
3
Empty display ON
2
Empty display OFF
4
Copying Flag=0?
No
Yes
5
Print SW(SW7) ON?
No
Yes
6
Paper empty?
ASSEMBLY
Yes
7
Generate VoiceI
8
No
Copying Flag←1
B
9
Scan Clutch ON
10
Timing SW(SW2)ON?
No
Yes
11
Timing Roller ON
12
Set Timer(T-A)
13
Set Timer(T-D)
14
Return SW(SW3)ON?
No
YES
15
Scan Clutch OFF
16
Return Clutch ON
17
Timer (T-D) end ?
No
Yes
18
Timing Roller OFF
19
Set Timer(T-B)
1

COPIER EQUIPPED WITH A SYSTEM FOR TRANSMITTING INFORMATION WITH VOICE

This is a continuation application under 37 CFR 1.62, of pending prior application Ser. No. 261,285 filed on May 6,1981.

BACKGROUND OF THE INVENTION

1. Field of the Invention

The present invention relates to a copier equipped with a system for transmitting information with a voice, and more particularly to a copier which, when a malfunction occurs, is adapted to detect the malfunction and which, when the user performs some action on the copier in this state, gives required information with a voice.

2. Description of the Prior Art

For example, when the paper feeder of an electronic copier is out of copy paper or the user forgets to set copy paper in place (such an instance will hereinafter be referred to as "empty"), or when the copier develops a malfunction such as jamming, the copier is controlled so as to prevent its copying operation or comes to a quick halt, while information is usually provided visually, by turning on a display lamp, for example, to notify the user of the malfunctioning state of the copier.

However, such information transmitting means of the conventional illumination type has the drawback that the operator is liable to overlook the information. When the copier is installed in a brightly lit place, such as beside a window, there is the problem that the operator is especially likely to fail to notice the display lamp when it is on.

Furthermore, with copiers including an audible alarm, such as a buzzer, for providing notice of malfunctions, when the alarm is adapted to remain on while the copier is malfunctioning, there are drawbacks in that the alarm produces a disturbing noise and it is difficult for the user to identify the malfunction.

SUMMARY OF THE INVENTION

The main object of the present invention is to provide a copier equipped with an information transmitting system for reliably informing the user of malfunctions of the copier with a voice.

Another object of the invention is to provide a copier equipped with an information transmitting system which, when the user performs some action on the copier, produces information with a voice for the reliable delivery of information to the user.

Another object of the invention is to provide a copier equipped with a system for reliably providing information to the user by producing information with a voice when the user attempts to start the operation of the copier without remedying the malfunction.

Still another object of the invention is to provide a copier equipped with an information transmitting system which, when the user opens the door of the copier for the correction of a malfunction, produces voice information for identifying the malfunction so as to reliably provide the information to the user.

More specifically, the present invention provides an information transmitting system comprising means for detecting malfunctions of a copier, means for storing voice signals corresponding to the malfunctions, means for producing a voice in correspondance with each of the voice signals, and control means for effecting control so as to cause the voice producing means to produce a voice based on its corresponding stored voice signal when the user performs an action on the copier while a malfunction is being detected.

More specifically, the invention provides an information transmitting system for a copier comprising: means for detecting, prior to the start of a copying operation, that the copier is in a nonoperative condition with respect to its copying operation, means for storing voice signals corresponding to each of the nonoperative states of the copier, means for producing a voice in correspondance with each of the stored voice signals, and control means for effecting control so as to cause the voice producing means to produce a voice based on its corresponding stored voice signal when the user executes a copying operation initiating procedure while a nonoperative state is being detected.

DETAILED DESCRIPTION OF THE INVENTION

Figure 1:
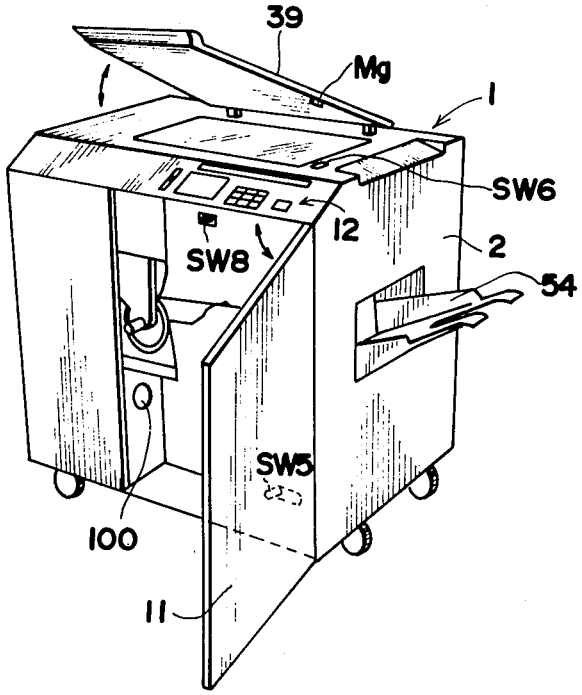
FIG. 1 is a view showing the appearance of a copier embodying the invention.
Figure 2:
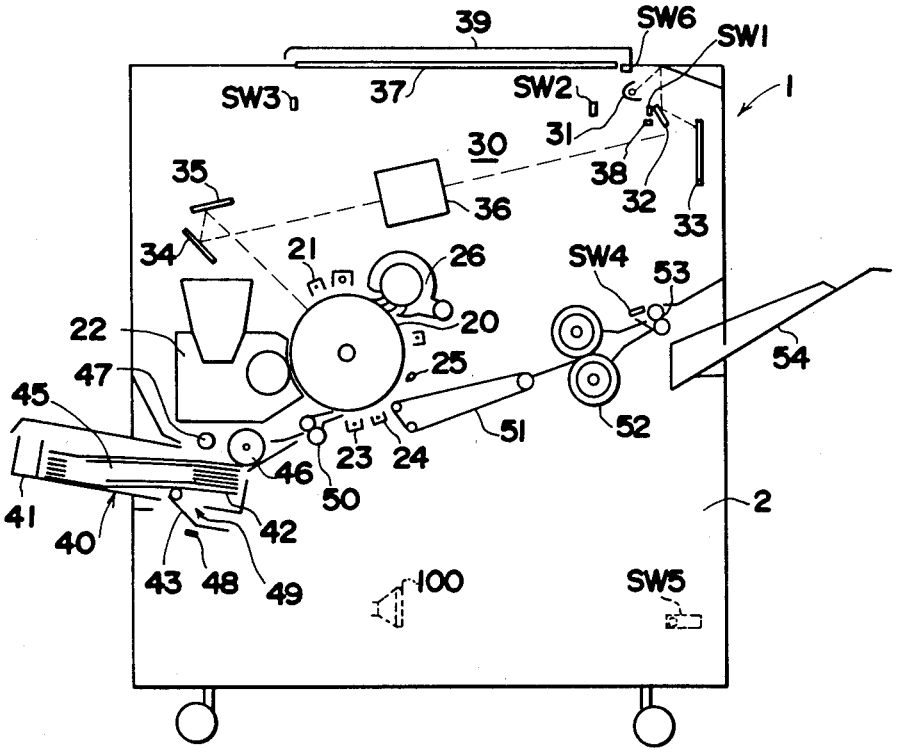
FIG. 2 is a sectional view schematically showing the interior construction of the copier.

FIGS. 1 and 2 show a specific embodiment of copier to which this invention is applied.

A copier 1 has a casing 2 in which a photoconductive drum 20 is rotatably supported. Arranged around the drum 20 are a sensitizing charger 21, developing unit 22, transfer charger 23, charge erasing A.C. charger 24, separating air nozzle 25 and cleaner 26.

An optical system 30 comprises a lamp 31, first reflecting mirror 32, second reflecting mirror 33, third reflecting mirror 34, fourth reflecting mirror 35, lens 36, etc. The lamp 31 and the first reflecting mirror 32 move together in the leftward direction as illustrated in FIG. 2 to scan an original (not shown) on a document support glass plate 37. The second reflecting mirror 33 also moves in the leftward direction as shown in the drawing figure at one half the speed of the lamp 31 and the first reflecting mirror 32 to project the image of the original on the drum 20 during the rotation thereof.

A copy paper stocking assembly 40 comprises a cassette main body 41 detachably inserted into the casing 2 of the copier, a plate 42 for placing sheets of copy paper 45 thereon, a pushing member 43 for pushing up the plate 42, etc. With the copy paper 45 held so as to be pressed against a feed roller 46, the feed roller 46 is rotated to feed the paper 45 into the copier. The paper 45 fed into the copier is transported by timing rollers 50, a conveyor belt 51, heat rollers 52 and discharge rollers 53 and is fed out of the copier onto a tray 54.

The optical system 30 is provided with a switch operating member 38 which is movable with the first reflecting mirror to actuate a positioning switch SW1, timing switch SW2 and return switch SW3. The switches SW1 to SW3 are, for example, reed switches, while the operating member 38 is a magnet.

The paper stocking assembly 40 is provided with a light emitting element 47 and a light receiving element 48 which are mounted on the copier main body and disposed above and below the cassette main body 41, respectively. In the absence of the cassette 41, or when the cassette 41 becomes empty and has no copy paper 45 therein, the light receiving element 48 receives light from the light emitting element 47 to detect the empty condition. When the cassette 41 is empty, the light from the element 47 passes through an opening 49 in the cassette 41 and an opening (not shown) in the plate 42 and impinges upon the receiving element 48.

A paper detecting switch SW4 disposed in the path of the transport of the copy paper 45 detects a paper jam in an operative relationship with a timer which operates so as to be timed with a copying operation. The detection of jams as well as the detection of an empty or absent paper cassette will be described later in detail.

When a sheet 45 jams the path, the copier 1 is controlled, for example, to stop its copying operation, whereupon the user or serviceman opens the front door 11 of the copier as seen in FIG. 1 and removes the jammed sheet. The door 11, when opened, actuates a door switch SW5, which detects the opening of the door 11.

When the stocking assembly 40 is empty and has no paper 45, the copier 1 is controlled so as to be inhibited from its copying operation. If the user depresses the start key for a copying operation at this time without noticing the empty stocking assembly, the information transmitting system to be described later functions, causing a loudspeaker 100 to produce a voice, saying, "Empty."

A cover 39 is closed for copying a thin original. When the cover 39 remains closed even after a predetermined period of time after the original has been copied with the cover closed, the speaker 100 produces a voice, saying, "Remove the original." Closing or opening of the cover 39 is detected by a switch SW6.

Figure 3:
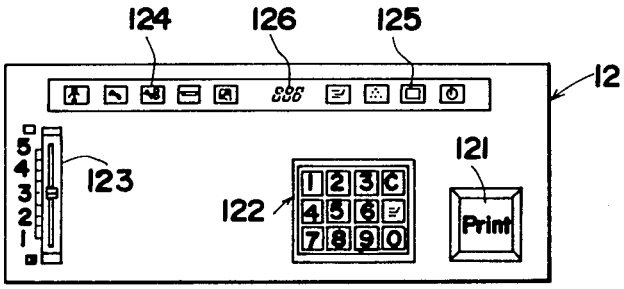
FIG. 3 is a view showing the operation panel of the copier in detail.

FIG. 3 illustrates in detail the control and display panel 12 shown in FIG. 1.

Element 121 is a print key for starting a copying operation; element 122 is a key arrangement for entering the copy number to be shown on a copy number display 126; element 123 is a density controller for controlling the brightness of the exposure lamp to adjust the density of copy images; element 124 is a jam display indicator, and element 125 is an empty display indicator.

Figure 4:
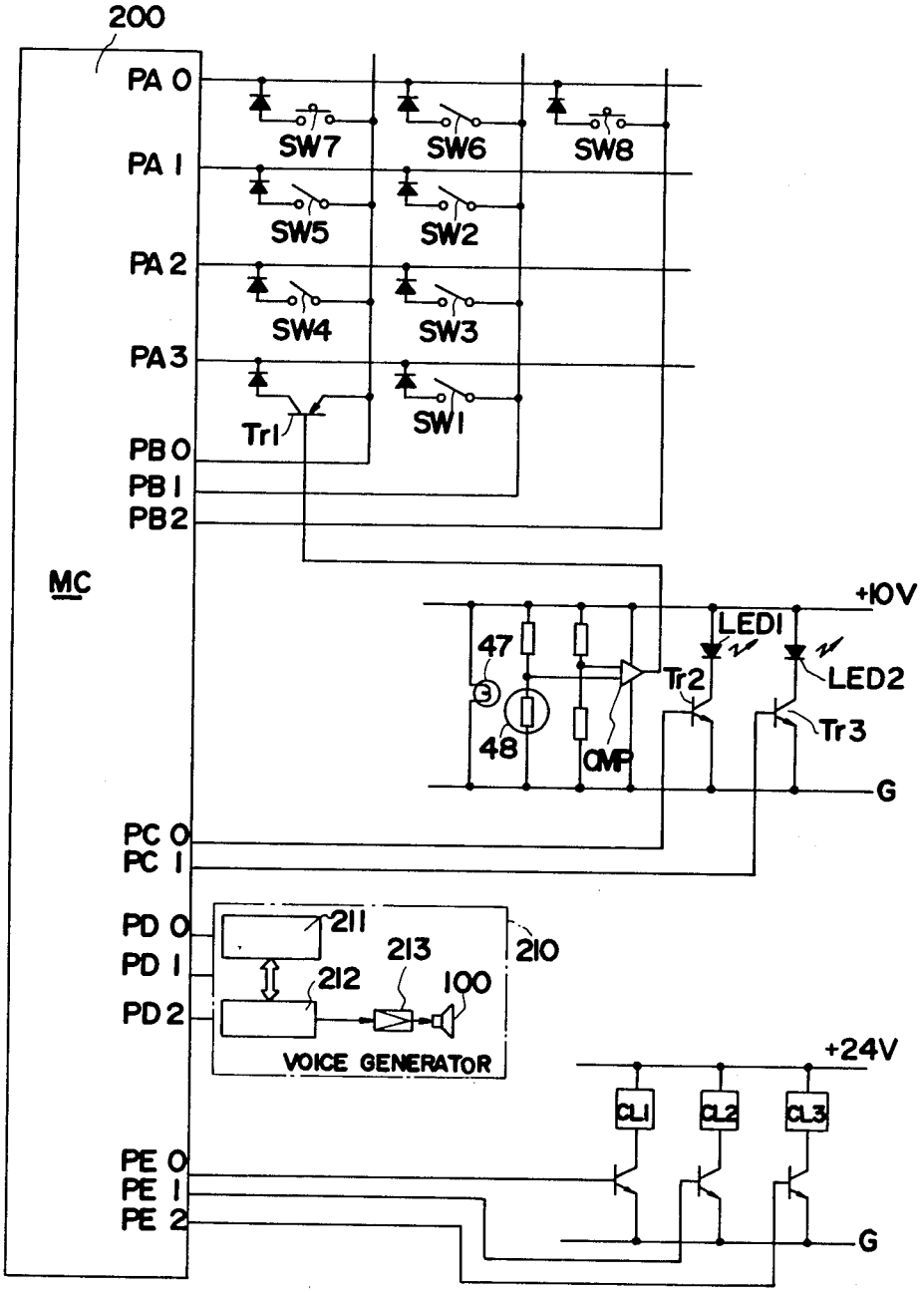
FIG. 4 is a diagram showing a circuit including a microcomputer for controlling the copier and an information transmitting system of the, invention.

As shown in FIG. 4, these keys and displays are associated with the operation of the copier 1 by a microcomputer (hereinafter abbreviated as "MC") 200 included in a control unit (not shown) within the copier. Similarly associated with the MC 200 are the foregoing switches SW1 to SW6, the switch SW7 to be operated by the print key 121, a jam reset switch SW8, etc.

The circuit shown in FIG. 4 will now be described, while the construction of the MC 200, which itself is known, will not be described.

The output of an output port PB0 of the MC 200 is fed to an input port PA0 via the door switch SW5, to an input port PA1 via the door switch SW5, to an input port PA2 via the jam detecting switch SW4, and to an input port PA3 via a switching transistor Tr1 which operates in accordance with the output of the light receiving element 48 for detecting an empty or absent paper cassette. The output of an output port PB1 is connected to the input port PA0 via the original cover switch SW6, to the input port PA1 via the timing switch SW2, to the input port PA2 via the return switch SW3, and to the input port PA3 via the positioning switch SW1. The output of an output port PB2 is connected to the input port PA0 through the jam reset switch SW8.

Output ports PC0 and PC1 are connected to the bases of switching transistors Tr2 and Tr3, respectively, such that when the output of ports PC0 and PC1 reach a high level, light-emitting diodes LED1 and LED2 for the empty display indicator 125 and the jam display indicator 124, respectively, emit light.

Output ports PD0 and PD2 are connected to a voice producing unit 210, wherein, in response to a selecting signal from the output ports PD0 to PD2, a digital signal representing a specified one of a plurality of message patterns stored in a memory 211 is outputted to a voice synthesizer 212. Upon receipt of an operating signal from one of the output ports PD0 to PD2, the voice synthesizer 212 converts the digital signal to an analog signal, which is amplified by an amplifier 213 and then fed to the speaker 100. Eight kinds of voice patterns are selectively usable, depending on whether the output from the output ports PD0 to PD2 is a logic "0" or "1." The number of such patterns increases with an increase in the number of output ports.

Output ports PE0, PE1 and PE2 respectively provide actuating signals for a clutch CL1 for moving the optical system 30 for scanning, a clutch CL2 for returning the system and a clutch CL3 for driving the timing rollers 50.

With the arrangement described above, the MC 200 delivers time-divided signals from output ports to check whether the detecting switches SW1 to SW8 are on or off so as to operate the displays and control the copying operation. A specific mode of control will be described below in accordance with the flow chart of FIGS. 5 and 6 and with reference to the time chart of FIG. 7.

Figure 5:
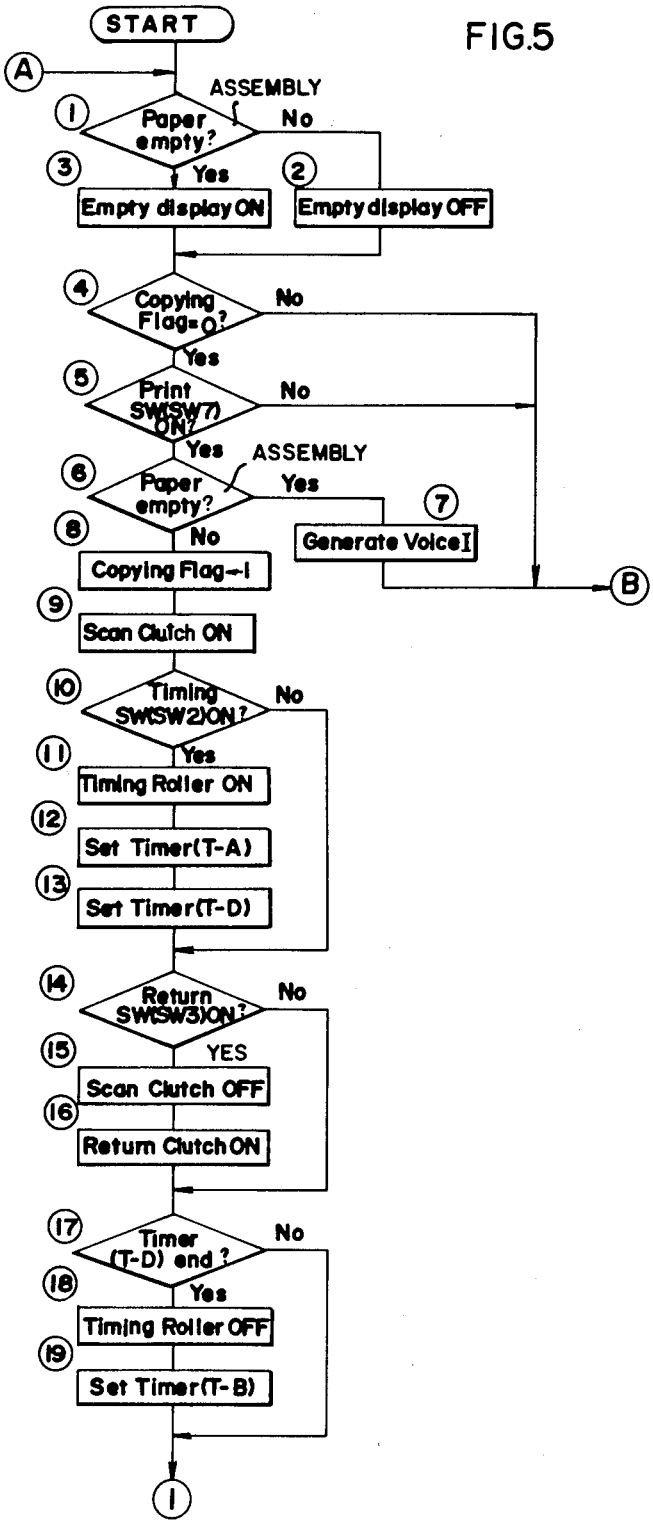
FIGS. 5 and 6 show a flow chart of the processing procedures executed by the microcomputer.

Referring to FIG. 5, a power switch (not shown) is closed to energize the copier 1 and the control circuit including the MC 200. The MC 200 is now initiated into operation. Copiers, such as the one shown in FIGS. 1 and 2, are so adapted that the apparatus is inhibited from starting a copying operation until the heat rollers 52 are heated to a predetermined temperature, and arranged such that a "1" automatically appears on the copy number display 126 upon energization of the system. However, such functions, which are known and are not directly relevant to the present invention, are not shown in FIGS. 5 and 6 and will not be described. Furthermore, although the flow chart of FIGS. 5 and 6 does not show the mode of control for the exposure lamp, developing unit and chargers, such means are controllable suitably with reference to the prior art disclosed, for example, in U.S. Pat. Nos. 4,033,692 and 4,054,380, while the technique therefor will be apparent to one skilled in the art from the description of FIGS. 5 and 6.

The empty papers assembly detecting light receiving element 48, shown in FIG. 4, associated with the paper stocking assembly 40 of FIG. 2, is checked for the level of its output in step (1) in the flow chart. Stated more specifically, if light is incident on the element 48, the transistor Tr1 conducts so as to cause a high output from a comparator (CMP), so that a discriminating signal is delivered from the output port PB0 of the MC 200 to the input port PA3, indicating that the assembly 40 is empty. This is followed by step (3), in which the output port PC0 of the MC 200 applies a high output to the light-emitting diode LED1 to light up the "empty" display indicator.

Step (4) checks the copy flag. If it is "0" (i.e.—the copier is not in a copying operation), the sequence proceeds to step (5), in which the print switch SW7 is checked as to whether it is on or not. If it is on, step (6) follows to check for an empty paper assembly. When the result of step (6) proves affirmative, a voice pattern I is generated in step (7) while the copier is being inhibited from its copying operation (i.e.—a logic "0" for the copy flag). The voice pattern I is a signal corresponding, for example, to the word "Empty." Thus, in response to an output from the output ports PD0 to PD2, the specified signal is selected from among the contents of the memory 211 and fed to the synthesizer 212.

When the stocking assembly 40 is not empty, or is replenished with paper and becomes no longer empty, a logic "1" is set for the copy flag in step (8) upon the closing of the print switch SW7. At the same time, the photoconductive drum 20 starts to rotate, the output port PE0 gives a high output to engage the scanning clutch CL1, and the exposure lamp 31 goes on and starts to travel with the first reflecting mirror 32 for scanning. Simultaneously, the sensitizing charger 21, developing unit, feed roller 46, etc. also start to operate for the formation of an image on the drum 20 and the transport of a copy sheet 45.

When the closing of the timing switch SW2 by the scanning movement of the optical system 30 has been detected in step (10), the output port PE2 delivers a high output to engage the timing roller clutch CS3 and drive the timing rollers 50 in step (11) for the transport of the sheet 45 in a timed relationship to the image on the drum 20. With the closing of the timing switch SW2, timers T-A and T-D are set in steps (12) and (13), respectively. The timer T-A is used for detecting jams as will be described later, while the timer T-D functions to stop the timing rollers 50 (see FIG. 7). The timers used herein may be digital timers programmed in the MC 200, i.e.—set in terms of numerical data in the memory of the MC 200. Timers provided by a microcomputer are disclosed in detail, for example, in the application manual for the μCOM 43 microcomputer of Nippon Denki Kabushiki Kaisha.

With a further scanning movement of the optical system 30, the return switch SW3 is turned on. This is detected in step (14), whereupon the scanning clutch CL1 is disengaged and the return clutch CL2 is engaged in steps (15) and (16). At the same time, the exposure lamp 31 is turned off and the sensitizing charger 21 is also turned off. The return switch SW3 may be mechanically shiftable in accordance with the length of the original.

Steps (17), (18) and (19) are adapted respectively to detect the lapse of time set on the timer T-D, to disengage the clutch CL3 so as to stop the timing rollers 50, and to set a timer T-B for the detection of jams to be described later. The timer T-D has a construction such as that disclosed in U.S. Pat. No. 4,211,482 and can be set at variable values in accordance with the length of the copy paper to be used.

Figure 6:
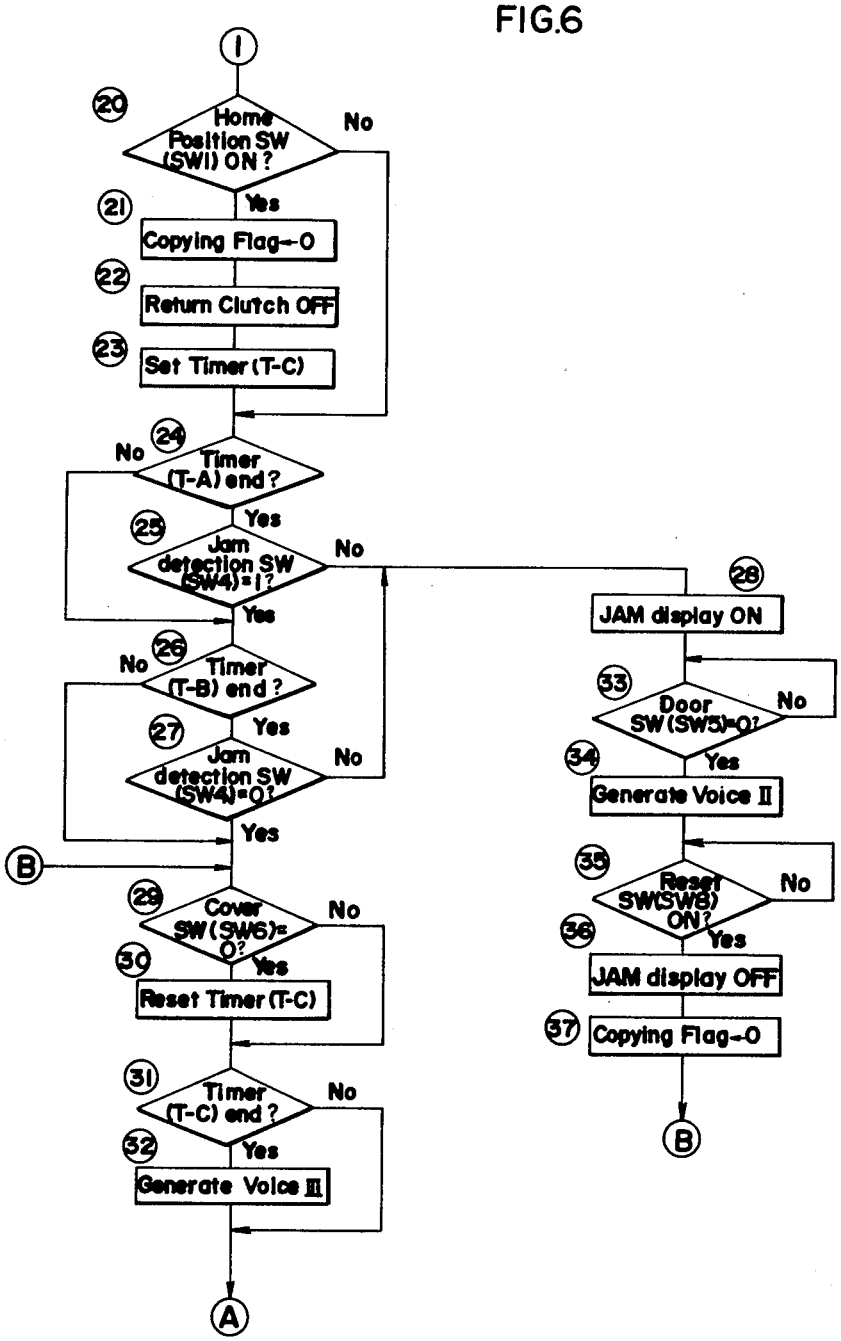
Figure 7:
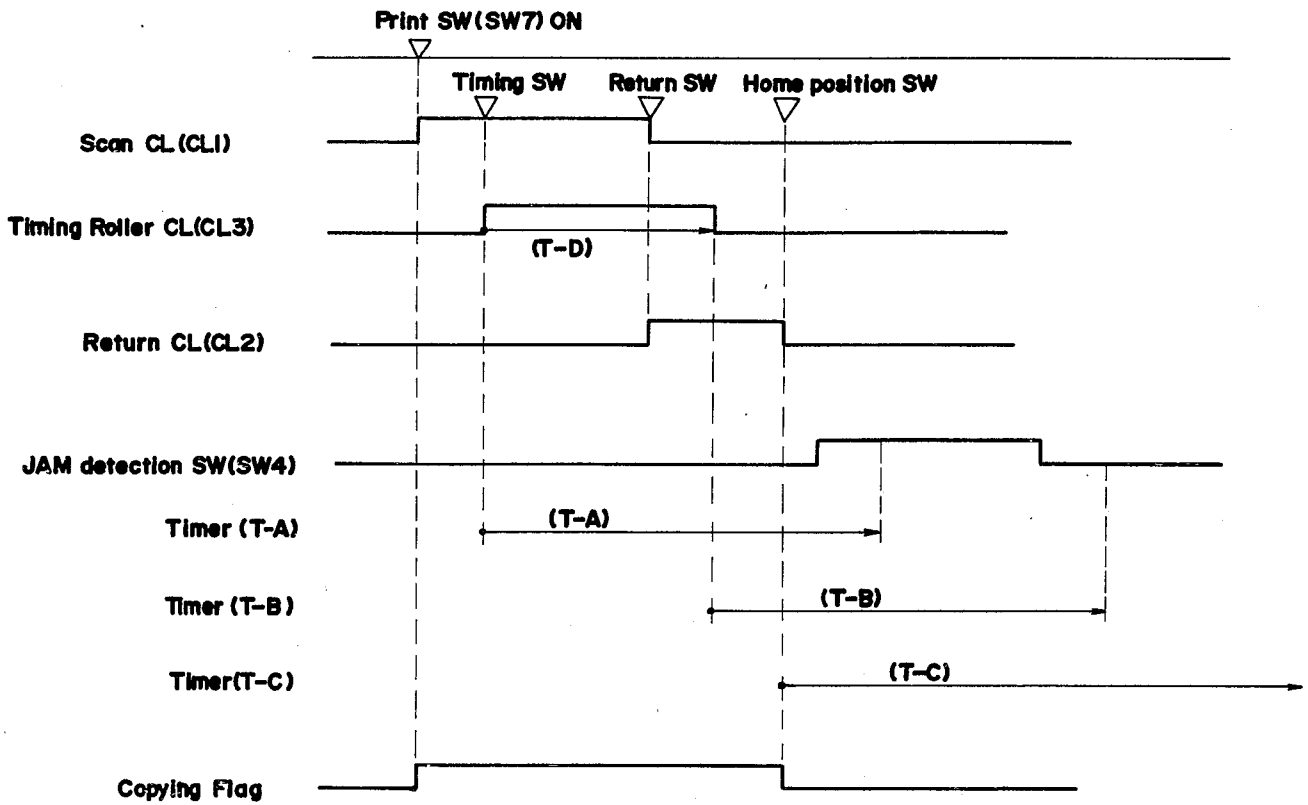
FIG. 7 is a time chart showing the relationship between the sequential operation of the copier and a jam detecting operation.

With reference to FIG. 6, step (20) detects that the returning optical system 30 has turned on the positioning switch SW1, whereupon the copy flag is changed to a logic "0" (i.e.—the state in which the copying operation has been completed), the return clutch CL2 is disengaged, and a timer T-C is set for reminding the user to remove the original in respective steps (21) to (23).

Steps (24) to (27) are provided for detecting jamming. A determination that jamming has occurred is reached when the switch SW4 is still off upon the lapse of time set on the timer T-A, and also when the switch SW4 is on upon the lapse of time set on the timer T-B. In step (28), the jam displaying light-emitting diode LED2 is turned on, and the drive motor and heater (not shown), for example, of the copier 1 are also turned off to quickly stop the copier.

The jam detecting timers T-A and T-B are so set that the time set on the timer T-A lapses when the leading end of the copy paper 45 being transported has reached the paper detecting switch SW4 and the time set on the timer T-B lapses when the rear end of the paper 45 being transported has passed by the switch SW4. Accordingly, a determination that jamming has occurred is reached when the copy paper has not been detected by the switch SW4 upon the lapse of time set on the timer T-A, and also when the paper is still detected by the switch SW4 upon the lapse of time set on the timer T-B.

When the copy paper 45 is properly transported, the sequence proceeds to steps (29) to (32) for reminding the user to remove the original. More specifically stated, upon the return of the optical system 30 to its normal position, the copy flag is set to a logic "0" and the reminder timer T-C is set. If the cover 39 remains closed for a predetermined period of time (e.g.—10 to 30 seconds) while the copier is not in its copying operation, a voice pattern III is provided upon the lapse of time set on the timer T-C for reminding the user of the removal of the original. When the voice pattern III is provided, a message, such as "Remove the original," is delivered from the speaker 100. The opening or closing of the cover 39 is detected by the switch SW6 which, for example, is a reed switch and which is provided in combination with a magnet Mg (see FIG. 1) attached to the cover 39.

When a paper jam is detected, the jam display 124 goes on, and the copier is stopped. The user or serviceman then opens the door 11 of the casing 2 to remove the paper. When the door 11 is thus opened while the jam is being detected, the door switch SW5 functions, which is detected in step (33). In step (34), a voice pattern II is provided, which is a signal corresponding, for example, to a message "Remove the paper." The user or serviceman then removes the jamming paper and operates the reset switch SW8 provided on a suitable portion of the copier main body to bring the copier out of the jam detecting state. In steps (36) and (37), the jam display is turned off and the copy flag is changed to a logic "0" in preparation for the subsequent copying operation.

As described above, the voice pattern I is provided when the print switch SW7 is operated by the user, and the voice pattern II is provided when the door 11 is opened by the user or serviceman. In each of these cases, a voice is produced from the speaker 100 in a corresponding relationship to the voice patterns to orally deliver the information to the operator present in the vicinity of the copier. Since the voice is produced only when the copier is operated subsequent to the detection of the malfunction, the voice will not cause discomfort to neighboring employees.

According to the technical concept of this invention, it is also possible to produce a voice, saying, "Jamming" when the user depresses the print key 121 without noticing a jam which has been detected, although this procedure is not illustrated in the flow chart. In such a case, step (28) of FIG. 6 would be followed by the step of checking whether or not the print switch SW7 is on, and then by the step of "production of voice" if the answer is affirmative. In the event of a paper jam, the user or serviceman must remove the jamming paper and operate the reset switch SW8, but the operator is likely to turn on the power switch or print switch SW7 while forgetting to operate the reset switch. In this case, the operator can be reminded of the resetting also with a voice. For example, the voice may be of the same pattern as the voice pattern II, or a voice, saying, "Cancel jam detection." For this purpose, step (35) is followed by the step of checking "Print key or power switch on?" for the negative answer and by the step of production of voice for the affirmative answer. Further when the copier develops malfunctions other than an empty paper assembly, such as wire breaks of the heater, lamps and chargers, which are detectable before the print switch SW7 is turned on, the copier may be so controlled according to the invention as to be prevented from starting its copying operation. If the print switch SW7 is turned on in the state of such a malfunction, a voice may be produced to indicate the malfunction. Furthermore, when a break or like malfunction occurs during a copying operation, the copier may be quickly stopped so as to notify the operator of the malfunction, and a voice may be produced when the door 11 is opened to remedy the malfunction. Suitable voice patterns are usable for different types of malfunctions. For the detection of various malfunctions, reference should be made to commonly assigned co-pending U.S. patent applications, Ser. No. 50,529 to Masayuki Maese and Tsuyoshi Nakakami (filed Jun. 21, 1979); Ser. No. 101,250 to Masazumi Ito, Kenji Shibazaki, and Tsuneo Kitazawa (filed Dec. 7, 1979) and Ser. No. 145,250 to Tsuneo Kitagawa, Kenichi Arai, Kenji Shibazaki, Tomoji Murata and Kenzo Nagata (filed Apr. 30, 1980) which is a continuation of Ser. No. 28,322 (filed Apr. 9, 1979, now abandoned), the disclosures of which are incorporated by reference herein.

Troubles or malfunctions of copiers, other than those mentioned above, include malfunctions of component units, failure in the drive circuits, improper installation of the developer and cleaner, and operation of the print switch when the copier is set for its manual mode. Since such malfunctions can be detected before the print switch is operated, the control system of the copier may have stored therein messages for these malfunctions.

When the copier is initiated into its copying operation in the absence of toner or without closing the document cover, an immediate malfunction is unlikely to occur, so that although a voice may be produced to merely deliver the information; there is no need to control the copier to stop the copying operation despite the operation of the print switch.

Thus, the system of this invention comprises means for detecting malfunctions of a copier, means for storing voice signals corresponding to the malfunctions, means for producing a voice in a corresponding relationship to each of the voice signals, and control means for effecting control so as to cause the voice producing means to produce a voice based on the corresponding one of the stored voice signals when the user performs an action on the copier while a malfunction is being detected. Accordingly, the desired information can be delivered to the operator reliably by a voice when he is present in the vicinity of the copier. Moreover, the voice, which is produced only when the copier is acted on, will cause no discomfort to neighboring employees.

The present invention further provides an information transmitting system for a copier comprising means for detecting, before the start of a copying operation, that the copier is not in a condition for a copying operation, means for storing voice signals corresponding to the nonoperative states of the copier, means for producing a voice in a corresponding relationship to each of the voice signals, and control means for effecting control so as to cause the voice producing means to produce a voice based on the corresponding one of the stored voice signals when the user executes a copying operation initiating procedure while a nonoperative state is being detected. In addition to the above advantages, the system has another advantage in that the user can be accurately and reliably notified of the cause for which the copier fails to start its copying operation.

We claim:

1. In a copying apparatus, the combination of a detecting means for detecting malfunctions of said copying apparatus and a system for transmitting information corresponding to the detected malfunctions, said system comprising:

manually actuable means for starting a copying operation of said copying apparatus;

means for storing voice signals corresponding to said detected malfunctions;

means for producing a voice corresponding to each of said voice signals, and control means for controlling said voice producing means to produce one of said voices based on its corresponding stored voice signal only when said manually actuable starting means is manually actuated while one of said malfunctions is being detected.

2. A copying apparatus as claimed in claim 1, wherein said detecting means comprises means for detecting, before the start of a copying operation, that said copying apparatus is in a nonoperative condition with respect to said copying operation.

3. A copying apparatus as claimed in claim 2, wherein said detecting means includes means for detecting, as a nonoperative condition of said copying apparatus, that a copying paper stocking assembly in said apparatus is empty.

4. A copying apparatus as claimed in claim 2, wherein said detecting means includes means for detecting, as a nonoperative condition of said copying apparatus, that a paper jamming has occurred in said apparatus.

5. A copying apparatus as claimed in claim 2, wherein said detecting means includes means for detecting, as a nonoperative condition of said copying apparatus, that a malfunction of a component unit of said copying apparatus has occurred.

6. In a copying apparatus, the combination of: a detecting means for detecting both malfunctions of elements in said copying apparatus and paper jamming in said copying apparatus, a door member which is openable for maintenance of said elements and for manually eliminating said paper jamming, and a means for transmitting information corresponding to said detected malfunctions or paper jamming, said means comprising:

means for storing voice signals corresponding to said detected malfunctions or paper jamming;

means for producing a voice corresponding to each of said stored voice signals;

means for detecting the opening of said door member; and control means for controlling said voice producing means to produce one of said voices based on its corresponding stored voice signal only when it has been detected that said door member is being opened while one of said malfunctions or paper jamming are being detected.

* * * * *